US009175939B1

(12) United States Patent
Wilfong et al.

(10) Patent No.: US 9,175,939 B1
(45) Date of Patent: Nov. 3, 2015

(54) CARTRIDGE FOR MUZZLE LOADING FIREARMS

(71) Applicants: Jeffrey Scott Wilfong, Ashtabula, OH (US); Timothy Scott Baumgerten, Austinburg, OH (US)

(72) Inventors: Jeffrey Scott Wilfong, Ashtabula, OH (US); Timothy Scott Baumgerten, Austinburg, OH (US)

( * ) Notice: Subject to any disclaimer, the term of this patent is extended or adjusted under 35 U.S.C. 154(b) by 0 days.

(21) Appl. No.: 14/495,131

(22) Filed: Sep. 24, 2014

Related U.S. Application Data

(60) Provisional application No. 61/881,632, filed on Sep. 24, 2013.

(51) Int. Cl.
*F42B 5/26* (2006.01)

(52) U.S. Cl.
CPC ..... *F42B 5/26* (2013.01)

(58) Field of Classification Search
CPC ..... F42B 5/00; F42B 5/18; F42B 5/26; F42B 5/285; F42B 5/307; F42B 14/00; F42B 14/06
USPC ..... 102/430, 520, 521, 431
See application file for complete search history.

(56) References Cited

U.S. PATENT DOCUMENTS

| | | | | | |
|---|---|---|---|---|---|
| 225,464 | A * | 3/1880 | Coloney | 102/439 |
| 3,617,593 | A * | 11/1971 | Alderfer | 264/46.7 |
| 3,658,008 | A * | 4/1972 | Larson | 102/431 |
| 4,195,550 | A * | 4/1980 | Witt et al. | 89/27.13 |
| 4,862,623 | A | 9/1989 | Delap | |
| 5,094,024 | A | 3/1992 | Duke | |
| 5,097,615 | A | 3/1992 | Kearns | |
| 5,164,539 | A * | 11/1992 | French | 102/520 |
| 5,182,412 | A | 1/1993 | Mazza | |
| 5,359,937 | A * | 11/1994 | Dittrich | 102/430 |
| 5,361,701 | A * | 11/1994 | Stevens | 102/450 |
| 5,458,064 | A * | 10/1995 | Kearns | 102/520 |
| 6,085,454 | A | 7/2000 | Caudle | |
| 6,253,682 | B1 * | 7/2001 | Saxby | 102/444 |
| 6,895,865 | B2 * | 5/2005 | Bond | 102/520 |
| 7,137,218 | B1 * | 11/2006 | Adkins, Jr. | 42/51 |
| 7,225,741 | B2 * | 6/2007 | Huffman | 102/434 |
| 7,726,245 | B2 * | 6/2010 | Quesenberry et al. | 102/432 |
| 2002/0050224 | A1 * | 5/2002 | Crowson et al. | 102/525 |
| 2003/0056416 | A1 * | 3/2003 | Crowson | 42/51 |
| 2004/0182274 | A1 * | 9/2004 | Bond | 102/520 |
| 2005/0115451 | A1 * | 6/2005 | Crowson | 102/525 |
| 2010/0269725 | A1 * | 10/2010 | Hall et al. | 102/520 |
| 2011/0048272 | A1 * | 3/2011 | Hall et al. | 102/517 |
| 2014/0130699 | A1 * | 5/2014 | Peterson et al. | 102/520 |

* cited by examiner

*Primary Examiner* — Jonathan C Weber
(74) *Attorney, Agent, or Firm* — Pearne & Gordon LLP

(57) ABSTRACT

Provided is a cartridge for a muzzle loading firearm. The cartridge includes a cylindrical sleeve portion defining an interior passage and a forward end comprising a tapered portion. A propellant charge is disposed within the interior passage, and an end cap defines a recess into which the tapered portion extends while the end cap is installed on the tapered portion. The end cap comprises a first fastener portion that cooperates with a second, compatible fastener portion provided to a bullet. The second fastener portion is disposed adjacent to a rearward end of the bullet to establish a friction fit between the bullet and the end cap that maintains a position of the bullet on the cartridge to be loaded into the muzzle loading firearm.

8 Claims, 3 Drawing Sheets

CARTRIDGE FOR MUZZLE LOADING FIREARMS

CROSS-REFERENCE TO RELATED APPLICATIONS

This application claims the benefit of U.S. Provisional Application No. 61/881,632, filed Sep. 24, 2014, which is incorporated in its entirety herein by reference.

BACKGROUND OF THE INVENTION

1. Field of the Invention

This invention relates generally to muzzle-loading rifles, pistols, cannons, and other firearms and, more particularly, to an improved cartridge arrangement for loading these firearms which allows the loading of the entire cartridge into the barrel through the muzzle without the use of additional implements or devices.

2. Description of Related Art

While muzzle loading firearms would be considered obsolete with the invention of modern breech loading cartridge rifles, there has long been a small degree of interest in the manufacture and use of such firearms. In recent years, the interest has increased greatly because such firearms are not subject to all of the restrictions on manufacture and sale that are applied to modern breech loading cartridge firearms. That interest has greatly increased in recent years because of new provisions in the hunting laws that permit extended seasons for hunting certain animals such as deer, which are only open for the use of muzzle loading rifles.

Furthermore, other factors which have led to increased and more widespread interest in muzzle loading firearms, are modern developments such as the development of a black powder substitute commonly known under the Trademark Pyrodex® as well as developments in the firearm itself such as the change from an external hammer to an inline action that externally resembles very much a standard high power bolt action rifle. Also, there have been many improvements in projectiles from the original round ball or Minie bullet and particularly the development of sabot projectiles employing a subcaliber jacketed rifle bullet which greatly improves the accuracy and range of the firearm.

However, the basic steps of loading a muzzle loading firearm have continued. To load the rifle, it is necessary to stand it on its butt with the open muzzle upward and then pour a measured charge of propellant powder into the open muzzle usually using a powder horn or a measuring device on the end of a bulk powder container to ensure that all of the powder enters the bore. When a round ball is used, it is necessary to use a patch which is placed over the muzzle and pressed downward by the round ball until it is seated within the bore. A ramrod is then used to force the ball and patch down the bore to bring all of the powder together into a combustion chamber at the bottom which is then closed off by the patched ball. After the ramrod is removed, the rifle is lifted up, the hammer cocked and a percussion cap placed on the nipple, after which the rifle is ready to be fired again. The foregoing procedure can take a period of time up to a minute or more, particularly after the barrel has become fouled from prior shots and if the user is determined to get a high degree of accuracy by the use of a proper fitting ball and patch which may require considerable force in starting down the muzzle. This slowness of loading was the reason that for military purposes smooth bore muzzle loaders prevailed until well into the 19th century.

An important step forward historically was the development of the Minie bullet which was roughly conical with a large hollow base and external grooves to receive a lubricant. The development of this bullet speeded up the loading process by eliminating the patch and by using a bullet just slightly smaller than the bore diameter of the barrel was easily forced downward onto the powder and upon ignition the thin walls of the bullet expanded and together with a lubricant provided an effective seal. This arrangement in turn led to the development of integral cartridges formed from paper which contained the powder charge and the bullet sealed together in a paper container. Loading was then speeded up since it was only necessary to tear off the powder end of the cartridge, pour the powder down the barrel and then using the ramrod force home the paper cartridge and bullet together. While such arrangements were widely used in the middle of the 19th century before development of the breech loading rifle, they did require considerable labor in the preparation of the cartridge, did allow possibility of spilling the powder and were generally limited to projectiles of the Minie bullet type.

Modern efforts to speed up the loading of muzzle loading rifles, particularly in the field, have tended to take a different tack from that used many years ago. These approaches have generally required the use of a cartridge assembly which includes a cylindrical body closed off in some means at the bottom end which is intended to be placed over the muzzle of the rifle. A bore extends upward and contains a premeasured charge of powder and is closed off at the upper end by means of the bullet which may either be a round ball and a patch or some other similar arrangement. Typical devices for this purpose are shown in U.S. Pat. No. 4,862,623 issued Sep. 5, 1989 to Delap et al. in which the bore at the bottom end is closed off by means of a quarter turn plug valve and the upper end has a snap cover with a captive hinge. U.S. Pat. No. 5,094,024 issued Mar. 10, 1992 to Duke discloses an outer cylinder arrangement designed to fit over the end of the muzzle and holding two smaller cylinders each closed off at each end by means of a rupturable membrane with the bottom cylinder holding the premeasured powder charge and the upper cylinder holding the ball and wad. This device is simply placed over the end of the barrel and a ramrod used to break the membranes and force the ball and the powder charge down the barrel. A somewhat similar arrangement is shown in U.S. Pat. No. 5,097,615 issued Mar. 24, 1992 to Kearns. This arrangement shows a device including a starter ramrod designed to fit over the barrel and uses tubular cartridges containing the premeasured powder charge, a wad or patch and a projectile which is inserted in the device and then pressed downward by the starter rod. A similar arrangement carrying multiple charges is shown in U.S. Pat. No. 5,182,412 issued Jan. 26, 1993 to Mazza.

The problem of all of the above devices is that they require an expensive apparatus which, while reusable, consists of separate parts which may easily lost in the field and must be retained for subsequent reuse. While such arrangements have shown some popularity their complexity, cost and bulk all represent shortcomings which are solved by the present invention.

BRIEF SUMMARY OF THE INVENTION

According to one aspect, the subject application involves a cartridge for a muzzle loading firearm. The cartridge includes a cylindrical sleeve portion defining an interior passage, the sleeve portion comprising a forward end comprising a tapered portion that defines an aperture with a cross-sectional area that is less than a cross-sectional area of the interior passage.

A propellant charge is disposed within the interior passage, and an end cap includes a peripheral defining a recess into which the tapered portion extends when the end cap is installed over the tapered portion. The end cap includes a first fastener portion, and a bullet includes a second fastener portion that is compatible with the first fastener portion of the end cap. The second fastener portion is disposed adjacent to a rearward end of the bullet to establish a friction fit between the bullet and the end cap that maintain a position of the bullet on the cartridge to be loaded into the muzzle loading firearm.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF SEVERAL VIEWS OF THE DRAWING

The invention may take physical form in certain parts and arrangement of parts, embodiments of which will be described in detail in this specification and illustrated in the accompanying drawings which form a part hereof and wherein.

DETAILED DESCRIPTION OF THE INVENTION

Figure 1:
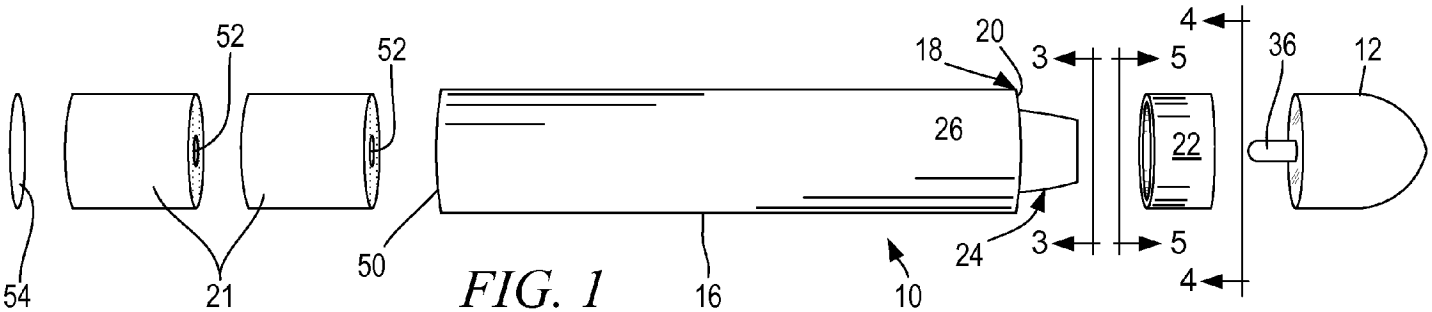
FIG. 1 is an exploded, side view of an embodiment of a cartridge.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is also to be noted that the phrase "at least one of", if used herein, followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

Figure 2:
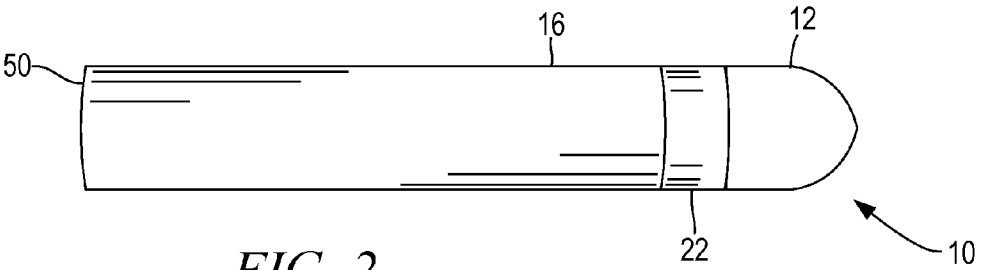
FIG. 2 is a side view of the cartridge appearing in FIG. 1 assembled, and in a condition for use with a muzzle-loaded firearm.

Referring now to the drawings in greater detail, FIGS. 1 and 2 show an illustrative embodiment of a cartridge 10 including a bullet 12 to be expelled from the muzzle end of a barrel 14 (FIG. 11) provided to a muzzle-loading firearm, when the firearm is fired. As shown, the cartridge 10 includes a sleeve portion 16 that is generally-cylindrical in shape. The sleeve portion 16 can be formed by stamping aluminum or otherwise forming a suitable metal or metal alloy, molding plastic, or otherwise forming a generally-cylindrical hollow tube with a substantially-uniform-diameter outer surface with dimensions adhering to a specific gauge (bore diameter) of the muzzle-loading firearm in which the cartridge 10 is to be loaded.

Notably, the sleeve portion 16 can be devoid of any structural features that cooperate with a portion of the barrel 14 or any other portion of the firearm to prevent the sleeve from being expelled along with the bullet 12. Conventional ammunition commonly loaded into a breach-loading firearm, revolver or semiautomatic handgun, or any other firearm within an action that can be opened to allow a conventional round to be loaded, includes a rim that protrudes radially outward, beyond the outside diameter of a housing containing gunpowder. This rim is typically located at the rear of conventional ammunition, adjacent to an onboard, self-contained primer that when struck, ignites the gunpowder and expels a slug from the barrel. In contrast, the present cartridge 10 can be configured to lack any features, such as a rim for example, that secures the sleeve portion 10 in place and interferes with the sleeve portion 10 being expelled from the muzzle end of the barrel 14 when the firearm is fired and the bullet 12 expelled. Instead, being muzzle-loaded, the cartridge 10 can be adapted to slide into the barrel 14 through the muzzle end and be expelled from the muzzle end of the barrel 14 in response to firing of the muzzle-loading firearm. Thus, the sleeve portion 16 can optionally be formed with a constant outside diameter along its length, and have an outer surface that is devoid of protuberances extending therefrom to allow the sleeve portion 16 to travel along the interior of the barrel 14 in response to the firearm being fired.

Figure 3:
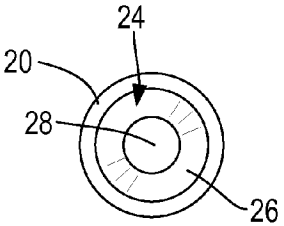
FIG. 3 is an end view of a sleeve portion of a cartridge including an aperture formed in a distal end thereof from the perspective of line 3-3 in FIG. 1.

The cartridge 10 includes a distal end 18 with a transversely-oriented wall 20, shown best in FIGS. 1 and 3, which can optionally be integrally formed as a monolithic unit with the rest of the sleeve portion 16, and have a suitable axial thickness to provide the wall 20 with sufficient strength so as not to rupture when the cartridge 10 is fired. It is contemplated that the cartridge 10 can be manufactured by stamping a metal or metal alloy such as aluminum, by injection molding from a suitably flexible plastic material such as low density polyethylene, to provide the wall 20 with its suitable axial thickness, however alternate embodiments can utilize a small metal, metal alloy or plastic reinforcing disc could to bolster the strength of the wall 20. In addition to containing the propellant charge 21 as described below, the wall 20 can establish a surface on which an end cap 22 can be seated when assembled.

In addition to the wall 20, the distal end 18 of the sleeve portion 16 can optionally include a tapered portion 24, which can also optionally be integrally formed as a monolithic unit with the remainder of the sleeve portion 16. As shown in FIGS. 1 and 3, the tapered portion 24 includes a conical perimeter wall 26 truncated at its end, to form a frustoconical shape. An aperture 28 (FIG. 3) is formed in the truncated end of the tapered portion 24, and leads to an interior of the sleeve portion 16 where the propellant charge 21 is located in an assembled cartridge 10. Thus, the tapered portion 24 acts as a type of nozzle through which expanding gasses produced in response to ignition of the propellant charge 21 exit the sleeve portion 16 to expel the bullet 12 from the barrel 14. Restricting the cross-sectional area of the aperture 28 to a value that is less than the cross-sectional area of the interior of the sleeve portion 16 serves to accelerate the expanding gasses as they exit the sleeve portion 16. Further, the conical perimeter wall 26 of the tapered portion 24 can serve to center the end cap 22 as the end cap 22 slides along the increasing diameter of the conical perimeter wall 26 towards the seat formed by the wall 20.

Figure 5:
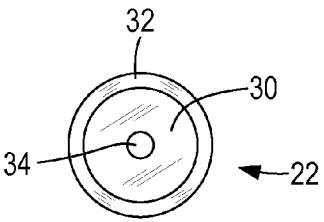
FIG. 5 is an end view of a forward end of an end of an end cap that can be placed atop a distal end of a sleeve portion, wherein the view appearing in FIG. 5 is taken from the perspective of line 5-5 in FIG. 1.
Figure 4:
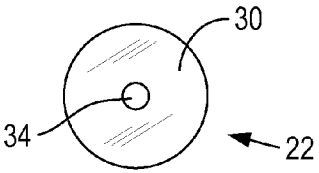
FIG. 4 is an end view of an open end of an end cap that can be placed atop a distal end of a sleeve portion, wherein the view appearing in FIG. 4 is taken from the perspective of line 4-4 in FIG. 1.

The end cap 22, shown in FIGS. 1, 4 and 5, is a generally cup-shaped structure formed from a metal, metal alloy, plastic, or other suitably-durable material, and fits over the tapered portion 24. As shown in FIG. 5, the interior of the end cap 22 is substantially hollow, being open at one end and terminated at the opposite end by a wall 30, surrounded by a generally-cylindrical perimeter wall 32 defining a recess within the end cap 22. The perimeter wall 32, and accordingly the recess, can have an axial length that is approximately the same distance the tapered portion 24 extends from the wall 20. So configured, the perimeter wall 32 can be seated on the wall 20 while the wall 30 of the end cap 22 is positioned adjacent to, and optionally in contact with the terminal end of the tapered portion 24 as part of the assembled cartridge 10, as shown in FIG. 2. An aperture 34 formed in the wall 30 of the end cap 22 is coaxially aligned, and optionally concentric with the aperture 28 on the assembled cartridge 10.

The bullet 12, as shown in FIG. 1, includes a protruding member 36 such as a peg, for example, that is to be inserted in, and received by the aperture 34 formed in the wall 30. The friction fit between the protruding member 36 and the surfaces defining the aperture 34 are sufficient to retain the bullet 12 in place at the end of the cartridge 10. As shown in FIGS. 1 and 2, the bullet 12 comprises a somewhat pointed shape, providing the bullet 12 with streamlined aerodynamics that promote straight flight through the air once the bullet has been expelled from the barrel 14. However, alternate embodiments of the bullet 12 can include a substantially spherical musket ball such as that appearing in FIGS. 9 and 10. Yet other embodiments of the bullet 12 can include a plurality of projectiles such as buckshot used with shotguns. For such embodiments, the shot can be contained within a cup that is integrally formed as part of the end cap 22, or placed on top of the end cap 22.

A plurality of different-caliber bullets 12 can each be provided with a commonly-configured protruding member 36, allowing a user to select any desired caliber of bullet 12 that is less than or equal to the caliber of the barrel 14 of the firearm that is to be loaded with the cartridge 10. Such bullets 12 can even be rendered interchangeable, meaning the friction fit between the protruding member 36 and the end cap 22 allows the bullet 12 to be removed and replaced by a different bullet 12 with the commonly-configured protruding member 36 that is compatible with the barrel 14.

A sub-caliber bullet 12 (e.g., a bullet 12 having a caliber that is smaller than the caliber of the barrel 14 of the firearm from which the bullet 12 is to be fired) with the commonly-configured protruding member 36 can optionally be installed as part of the cartridge 10 to be expelled from the barrel 14. In such instances, a sabot 38 such as that appearing in FIGS. 6, 7 and 8 can be used to fill the gap between the external periphery of the sub-gauge bullet 12 and the internal periphery of the barrel 14. According to the illustrated embodiment, the sabot 38 includes an aperture 40 at its base 42, which is to rest on the wall 30 of the end cap 22, when assembled. The aperture 40 is positioned along the base 42 to be coaxially aligned with the aperture 28 (FIG. 3) of the tapered portion 24 and the aperture 34 of the end cap 22 in the assembled cartridge 10. The protruding member 36 extends through at least the aperture 40, and optionally at least partially through the aperture(s) 34 and/or 28 of the end cap 22 and tapered portion 24, respectively, depending on the length of the protruding member 36 to hold the sabot 38 and the sub-caliber bullet 12 in place.

A plurality of fingers 44 extend away from the base 24 to form a sectioned perimeter about the bullet 12, with intervening slots 46 (FIG. 6) arranged between the fingers 44. The fingers 44 and intervening slots 46 form a forward-opening cylindrical cup-like structure with a flexible grip on the bullet 12. According to other embodiments, the fingers 44 can be replaced by a solid, peripheral wall that extends fully about the circumference of the bullet 12 at its widest point. The sabot 18 (or the bullet 12 for full caliber embodiments) has a sufficient diameter to form a substantial seal between the outside diameter of the sabot 18 or bullet 12 and the inside surface of the barrel 14. Although this seal is not necessarily hermetic, it is sufficient to ensure most of the energy from the expanding gases resulting from ignition of the propellant charge 21 as described below is utilized to expel the sabot 38 and/or bullet 12 from the muzzle of the barrel 14 when the firearm is fired. For example, if the cartridge 10 is for a 50 caliber rifle having a bore diameter of exactly 0.500 inches, the sabot 18 is formed to snugly receive a bullet 12 of 44 caliber predominately 0.429 inch diameter. Likewise, the sleeve portion 16 of the cartridge 10 is formed to have an outside diameter of about 0.490-0.495 inch so as to be a suitable fit within the rifle bore as explained in greater detail hereinafter.

According to alternate embodiments, the sabot 38 can be configured to form a substantially solid cup-like structure without intervening slots 46, or with intervening slots 46 that are smaller than the diameter of shot comprising a plurality of loose projectiles (e.g., shotgun pellets such as number 8 shot). The perimeter wall of such an embodiment of a sabot 38 can be scored to allow the shell to open up when expelled from the barrel 14, thereby increasing wind drag to cause the expelled sabot 38 to quickly separate from the shot being fired from the barrel 14.

Figure 8:
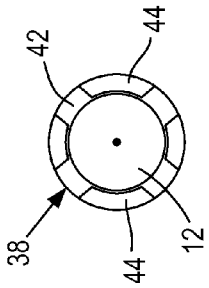
FIG. 8 is an end view of the assembled sabot assembly from the perspective of line 8-8 shown in FIG. 7.
Figure 7:
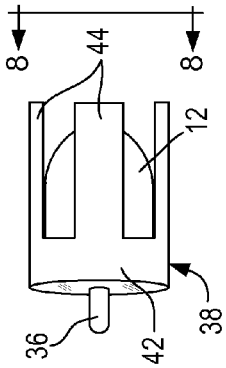
FIG. 7 is an assembled view of the sabot assembly shown in FIG. 6.
Figure 6:
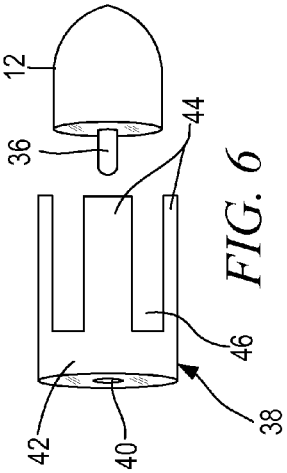
FIG. 6 is an exploded view of a sabot assembly that can be used to properly position a rifle slug, optionally a sub-caliber slug, within a barrel of a muzzle-loading firearm.
Figure 12:
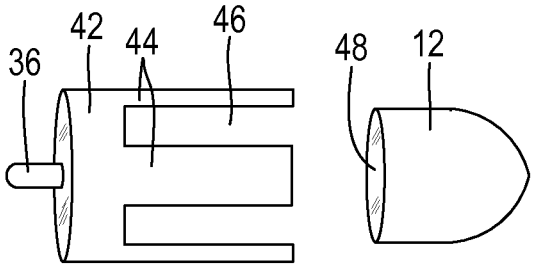
FIG. 12 is an exploded view of an alternate embodiment of a sabot assembly that can be used to properly position a sub-caliber slug within a barrel of a muzzle-loading firearm.

The embodiments of the sabot 38 appearing in FIGS. 6-8 include an aperture 40 into which the protruding member 36 provided to the bullet 12 is to extend to establish the friction fit that is to hold the bullet 12 in place. However, according to another embodiment illustrated in FIG. 12, the sabot 38 itself can be provided with the protruding member 36 instead of the bullet 12, which includes a planar rear surface 48 that is to rest on the base 42 of the sabot 38. According to such embodiments, the protruding member 36 of the sabot 38 is inserted into the aperture 34 of the end cap 22, and the bullet 12 is received between the fingers 44 or other form of periphery to be held in place on the cartridge 10.

Figure 13:
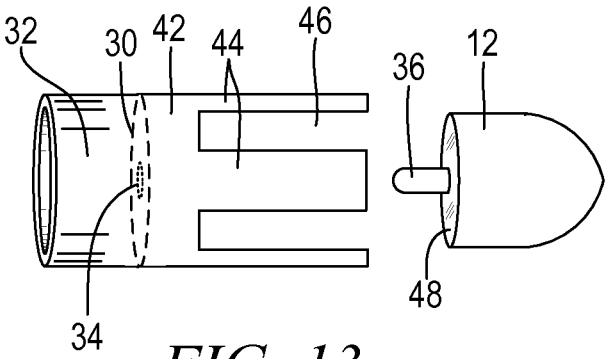
FIG. 13 is an exploded view of an alternate embodiment of a sabot assembly including an integrally formed end cap that can be used to properly position a sub-caliber slug within a barrel of a muzzle-loading firearm.

According to yet another embodiment illustrated in FIG. 13, the sabot 38 and end cap 22 can be integrally formed together as a monolithic unit, eliminating the need for a separate end cap 22 and sabot 38. The end cap portion of the sabot 38 can include the generally-cylindrical perimeter wall 32 and end wall 30 (shown as hidden lines in FIG. 13) that were described with reference to FIG. 5, to be installed on the tapered portion 24 of the sleeve portion 16. Likewise, the sabot portion of the present embodiment of the sabot 38 can be configured similar to the structure described above for the other embodiments of the sabot 38.

Figure 10:
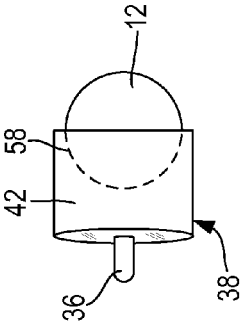
FIG. 10 is an assembled view of the sabot assembly shown in FIG. 9.
Figure 9:
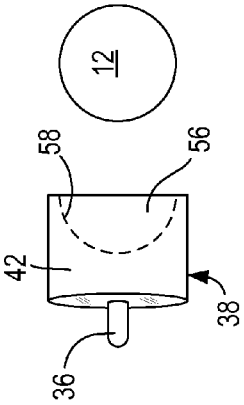
FIG. 9 is an exploded view of a sabot assembly that can be used to properly position a musket ball within a barrel of a muzzle-loading firearm.

According to yet another embodiment, the sabot 38 can be configured to support a musket ball embodiment of the bullet 12 as shown in FIGS. 9 and 10. For such an embodiment, the sabot 18 can include a base 42, but includes a recess 56 defined by an arcuate wall 58 shown in hidden lines in FIGS. 9 and 10. The shape and dimensions of the arcuate wall 58 should closely approximate the external shape of the musket ball embodiment of the bullet 12 so the bullet 12 can be snugly received within the recess 56 as shown in FIG. 10. The protruding member 36 can extend from the base 42 of the sabot 38 to be inserted into the aperture 34 of the end cap, and/or the aperture 28 defined by the tapered portion 24.

The sleeve portion 16 can be of the same nominal diameter as the barrel 14, with a rearward end 50 comprising a circular rear opening leading into the interior of the sleeve portion 16 where the propellant charge 21 is to be housed. The sleeve portion 16 can include a radial wall thickness in the range of 0.15 to 0.45 inches as determined by the size of the cartridge 10 and the expected maximum chamber pressures when the cartridge 10 is fired. If it is decided to make relatively thin walls, the inner surface of the sleeve portion 16 can optionally be provided with reinforcing ridges.

The opening at the rearward end 50 of the sleeve portion 16 is suitably sized to receive the propellant charge 21 that is to be ignited to expel the bullet 12 from the barrel 14. The propellant charge 21 can be any suitably-combustible material such as loose or pelletized smokeless gunpowder, black powder or gunpowder substitute such as Pyrodex. For the illustrative embodiment appearing in FIG. 1, the propellant charge 21 includes a plurality of cylindrically-shaped black powder pellets with an outside diameter that is slightly smaller than, but closely approximating the internal diameter of the sleeve portion 16. Each pellet can optionally include an aperture 52 through which an ignition source can travel to concurrently ignite as much of the pellets as possible, thereby improving the pressure resulting from the expanding gasses.

With the pellets of the propellant charge 21 inside the sleeve portion 16, a membrane 54, shown in FIG. 1, can optionally be placed at the rearward end 50 of the sleeve portion 16 to enclose the propellant charge 21 within the sleeve portion 16. The membrane 54 can optionally be integrally formed as a monolithic unit with the sleeve portion 16, enclosing the propellant charge 21 at the time of manufacture, separately installed at the rearward end 50, or otherwise provided to the rearward end 50 as desired. The membrane 54 can be made of any suitable material to form a water-resistant barrier that contains and protects the propellant charge 21 within the sleeve portion 16. However, the membrane 54 has an aperture in the axial dimension, or is solid (e.g., lacking an aperture), to fully enclose the propellant charge within the sleeve portion 16 and is pierced when, or before, the cartridge 10 is inserted into the barrel 14 to allow the ignition source (e.g., spark from a percussion cap, for example) to reach and ignite the propellant charge 21 and discharge the round. According to alternate embodiments, the membrane 54 can be suitably thin in the axial direction of the sleeve portion 16 to be pierced by a portion of a nipple assembly 60 described below when the cartridge 10 is loaded. Yet other embodiments utilize a membrane 54 that is fabricated, at least in part, of a suitable material (e.g., a combustible material) or has a suitable axial dimension that allows the ignition charge to pierce (e.g., a spark) the membrane 54 and ignite the propellant charge 21. The cartridge 10 can optionally be fully assembled and then sold individually or in a package comprising a plurality of cartridges 10 that can each optionally have a bullet 12, or lack a bullet 12 to allow the end user to separately purchase the bullet 12 of a desired caliber and install the selected bullet 12 as desired.

According to alternate embodiments, the rearward end 50 can optionally be left open, and not enclosed by the material of the sleeve portion 16 or the membrane 54. This allows the desired propellant charge 21 to be inserted into the barrel 14 by the user, and the open-ended cartridge 10 then inserted into the barrel 14 over the propellant charge 21.

Figure 11:
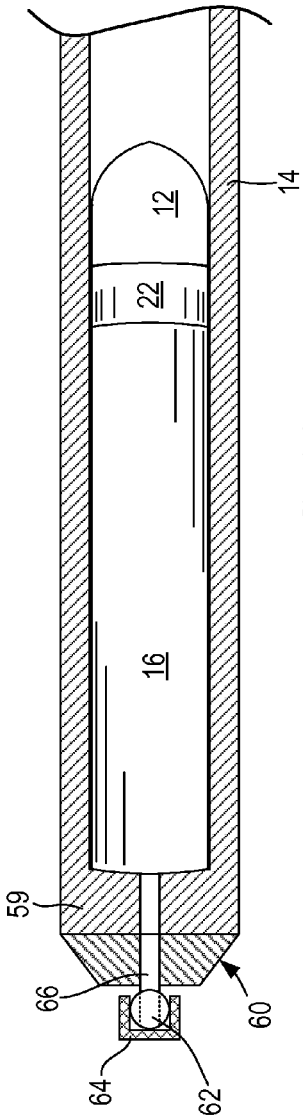
FIG. 11 is a partially cutaway view of a cartridge within a barrel of a muzzle-loading firearm.

As shown in FIG. 11, the cartridge 10 is schematically shown in place within a barrel 14 of a muzzle-loading firearm, closed off at the rear 59 by a suitable nipple assembly 60 having a nipple 62 extending axially there through. The nipple 62 is intended to mount a percussion cap 64 or similar device. The nipple assembly 12 also includes a primer gas tube 66 that extends between the nipple 62 and the propellant charge 21 within the sleeve portion 16, and can optionally pierce the membrane 54, to convey the ignition source from the percussion cap 64, for example, as required to ignite the propellant charge 21.

The sleeve portion 16 is made of such a diameter as to snuggly fit within the barrel 14, but not too tight fit down the barrel 14 as it is pushed inward as a unit from the muzzle end of the barrel 14. The sleeve portion 16 can optionally include a smooth surface or optionally include pits formed on the external surface of the sleeve portion 16 to contain a lubricant that can be at least partially applied to the interior surface of the barrel 14 as the cartridge 10 is inserted into the barrel. When the rifle is fired, the propellant charge 21 is ignited and rapidly burns to generate expanding gasses force the entire cartridge 10 and bullet 12 out the muzzle of the barrel 14 where the bullet 12 separates from the sleeve portion 16 (and optionally the sabot 38) to fly to the target. The cartridge sleeve portion 16 of the cartridge 10, being of light weight and high drag, quickly separates from the bullet 12, slows down, and falls to the ground.

The sleeve portion 16 can also optionally be provided with an annular-shaped scraper ring adjacent to a rearward end 50 of the sleeve portion 16. A central aperture formed in the scraper ring allows the ignition source to reach the propellant charge 21. The scraper ring can be sized with an outside diameter that is approximately equal to the outside diameter of the sleeve portion 16, or with an outside diameter such that the circumference of the scraper ring is at least partially visible when viewing the outside surface of the sleeve portion 16, slightly less than, but very close to the interior diameter if the barrel 14.

As the weapon is fired the pressure from the expanding gases inside the sleeve portion 16 urges the lubricant in an outward direction from the optional pits and onto the interior surface of the barrel 14. This lubricant can at least partially coat the inside of the barrel 14 to reduce the buildup of carbon on the inside of barrel 14 from an amount of deposition that would otherwise occur in the absence of the lubricant. The scraper ring at rearward end 50 of sleeve portion 16 can cause a scraping force to be exerted on the inside wall of the barrel 14 as the sleeve portion 16 is expelled down the barrel 14 toward the muzzle when the cartridge 10 is fired. This causes the wall of the barrel 14 to be scraped by the cartridge 10 while traveling along the barrel 14, at least partially removing any carbon buildup from previous rounds that have been fired and/or lubricant applied to the interior wall of the barrel 14. Accordingly, more rounds can be fired before a carbon or other contaminant buildup creates the need for cleaning, and may allow the user to fire the firearm indefinitely without requiring the barrel 14 to be cleaned as a result of carbon buildup.

Illustrative embodiments have been described, hereinabove. It will be apparent to those skilled in the art that the above devices and methods may incorporate changes and modifications without departing from the general scope of this invention. It is intended to include all such modifications and alterations within the scope of the present invention. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A cartridge for a muzzle loading firearm, the cartridge comprising:

a cylindrical sleeve portion formed from a non-combustible material that defines an interior passage, the sleeve portion comprising a forward end relative to a firing direction comprising a tapered portion that defines an aperture with a cross-sectional area that is less than a cross-sectional area of the interior passage, and a rearward end portion that is arranged adjacent to an opposite end of the cylindrical sleeve portion and is separated from the forward end by the interior passage, wherein the sleeve portion is devoid of a retention feature that cooperates with a portion of the muzzle loading firearm that interferes with expulsion of the sleeve portion through a muzzle of the muzzle loading firearm so the sleeve portion is expelled from the muzzle in response to a discharge of the cartridge;

a propellant charge disposed within the interior passage;

a membrane provided to the rearward end portion to be positioned adjacent to a closed rear of a barrel and substantially enclose the propellant charge disposed within the interior passage;

an end cap comprising a peripheral wall that defines a recess into which the tapered portion extends with the end cap installed over the tapered portion, wherein the end cap comprises a first fastener portion; and a bullet comprising a second fastener portion that is compatible with the first fastener portion of the end cap, the second fastener portion being disposed adjacent to a rearward end of the bullet to establish a friction fit between the bullet and the end cap that maintains a position of the bullet on the cartridge to be loaded into the muzzle loading firearm.

2. The cartridge of claim 1 wherein the membrane is solid, and is to be pierced to allow an ignition source to ignite the propellant charge within the sleeve portion.

3. The cartridge of claim 1, wherein the recess in the end cap comprises an axial length that is approximately equal to an axial length of the tapered portion.

4. The cartridge of claim 1, wherein the first fastener portion comprises an aperture formed in a central region of an end wall of the end cap, and the second fastener portion comprises a protruding member that extends from the rearward end of the bullet and is insertable into the aperture formed in the central region of the end wall to establish the friction fit.

5. The cartridge of claim 4, wherein the protruding member comprises dimensions that are equal to dimensions of another protruding member provided to another bullet of a caliber that is different than a caliber of the bullet.

6. The cartridge of claim 1 further comprising a sabot disposed between the sleeve portion and the bullet.

7. The cartridge of claim 1, wherein the sleeve portion is formed from a metal or a metal alloy.

8. The cartridge of claim 1, wherein the sleeve portion is formed from a plastic material.

* * * * *